US008192556B2

(12) United States Patent
Giordani et al.

(10) Patent No.: US 8,192,556 B2
(45) Date of Patent: Jun. 5, 2012

(54) PICKLING OR BRIGHTENING/PASSIVATING SOLUTION AND PROCESS FOR STEEL AND STAINLESS STEEL

(75) Inventors: Paolo Giordani, Crema (IT); Valentino Gasparetto, Olgiate Molgora (IT); Mauro Rigamonti, Opera (IT)

(73) Assignee: Henkel KGaA, Duesseldorf (DE)

( * ) Notice: Subject to any disclaimer, the term of this patent is extended or adjusted under 35 U.S.C. 154(b) by 727 days.

(21) Appl. No.: 10/531,113

(22) PCT Filed: Apr. 25, 2003

(86) PCT No.: PCT/EP03/04306

§ 371 (c)(1),
(2), (4) Date: Nov. 4, 2005

(87) PCT Pub. No.: WO2004/035861

PCT Pub. Date: Apr. 29, 2004

(65) Prior Publication Data

US 2006/0076247 A1 Apr. 13, 2006

(30) Foreign Application Priority Data

Oct. 15, 2002 (WO) ..... PCT/EP02/11483

(51) Int. Cl.
*C23G 1/08* (2006.01)
*C23G 1/04* (2006.01)

(52) U.S. Cl. ..... 134/41; 134/2; 134/3; 510/245; 510/258; 510/269; 510/363; 510/365; 510/401; 148/254

(58) Field of Classification Search ..... 134/2–3, 134/41; 148/254; 510/245, 258, 269, 363, 510/365, 401

See application file for complete search history.

(56) References Cited

U.S. PATENT DOCUMENTS

| | | | | |
|---|---|---|---|---|
| 3,025,189 | A | 3/1962 | Arden | |
| 4,298,404 | A * | 11/1981 | Greene | 148/247 |
| 4,502,925 | A | 3/1985 | Walls | |
| 5,427,632 | A * | 6/1995 | Dolan | 148/259 |
| 5,908,511 | A * | 6/1999 | Bianchi | 134/3 |
| 6,194,369 | B1 * | 2/2001 | Eberhardt et al. | 510/258 |
| 6,312,812 | B1 | 11/2001 | Hauser et al. | |
| 6,361,613 | B2 * | 3/2002 | Lee | 134/3 |
| 6,565,735 | B1 * | 5/2003 | Fortunati et al. | 205/704 |
| 6,833,328 | B1 * | 12/2004 | Kool et al. | 438/745 |
| 2004/0065389 | A1 * | 4/2004 | Kolberg et al. | 148/256 |

FOREIGN PATENT DOCUMENTS

| | | | |
|---|---|---|---|
| BE | 1003954 | A6 | 9/2003 |
| DE | 37 42 367 | A1 | 6/1989 |
| DE | 198 28 811 | C1 | 12/1999 |
| EP | 0 167 751 | A1 | 1/1986 |
| EP | 0 505 606 | A1 | 9/1992 |
| EP | 0 582 121 | A1 | 2/1994 |
| EP | 0 596 273 | A1 | 5/1994 |
| EP | 0 769 574 | A1 | 4/1997 |
| EP | 0 795 628 | B1 | 5/2001 |
| EP | 1 050 605 | B1 | 10/2004 |
| GB | 1 449 525 | | 9/1976 |
| GB | 2 265 612 | A | 10/1993 |
| JP | 61-276999 | * | 12/1986 |
| JP | 02-121689 | A | 4/2002 |
| WO | WO 97/43463 | A1 | 11/1997 |
| WO | WO 98/26111 | A1 | 6/1998 |
| WO | WO 99/31296 | A1 | 6/1999 |
| WO | WO 00/15880 | * | 3/2000 |
| WO | WO 01/49899 | A2 | 7/2001 |
| WO | WO 02/070781 | A2 * | 9/2002 |
| WO | WO 2004/002077 | A1 | 3/2004 |

* cited by examiner

*Primary Examiner* — Lois Zheng
(74) *Attorney, Agent, or Firm* — Mary Cameron

(57) ABSTRACT

The use of complex fluoride ions of elements of groups 4, 13, or 14 of the periodic table of the chemical elements (preferably selected from complex fluoride ions of the elements B, Si, Ti, and Zr) in concentrations from 30 t 500 millimoles per liter in process solutions for pickling steel or for bleaching and/or passivating pickled surfaces of stainless steel; a process solution for pickling steel or bleaching and/or passivating pickled surfaces of stainless steel comprising: a) one or more strong acids, b) one or more oxidizing agents in the bleaching/passisvating process, c) complex fluoride ions of elements of groups 4, 13 or 14 of the periodic table of the chemical elements in concentrations from 50 to 500 mmoles per liter; replenisher or concentrate containing a combination of active substances thereof; a process for pickling steel or for brightening and/or passivating of pickled surfaces of stainless steel, wherein the surfaces are brought into contact with such a process solution.

18 Claims, No Drawings

PICKLING OR BRIGHTENING/PASSIVATING SOLUTION AND PROCESS FOR STEEL AND STAINLESS STEEL

This application is the National Stage of International Application No. PCT/EP03/04306, filed 25 Apr. 2003, and published in English, from which priority is hereby claimed, as well International Application No. PCT/EP02/11483, filed 15 Oct. 2002, abandoned, which is the priority document for International Application No. PCT/EP03/04306.

This invention relates to a process for brightening and/or passivating special steel (also termed "stainless steel") after pickling, and to a process for pickling low-chromium steel or stainless steel. In general, technical steels are termed non-rusting or stainless if rust formation is prevented under normal environmental conditions, for example in the presence of atmospheric oxygen and moisture and in aqueous solutions. Most high-alloy, so-called corrosion-resistant or acid-resistant steels withstand relatively severe corrosion conditions, for example acids and salt solutions. These steels are generically referred to as special steels or stainless steels. A list of the technically most important special steels, together with the material numbers, identifications and alloy components, as well as the mechanical and chemical properties thereof are given in Ullmanns Encyklopädie der technischen Chemie, 4th Edition, Vol. 22, pp. 106-112 and in German Industrial Standard DIN 17440, July 1985. Special steels are iron based alloys containing at least 10% chromium. The formation of chromium oxide on the material surface imparts to the special steels the corrosion-resistant character thereof.

Special steels may be sub-divided into the following families: austenitic steels, ferritic steels, martensitic steels, precipitation hardened steels and duplex steels. These groups differ in the physical and mechanical properties thereof, as well as in corrosion resistance, as a result of the various alloying constituents. Austenitic special steels are listed as special steels of the 200 and 300 Series. They are the most widely employed special steels and represent 65 to 85% of the special steel market. They are chemically characterized by a chromium content of >17% and a nickel content of >8%. They have a cubic face-centered structure and are outstandingly ductile and weldable. The most widely used of these steels is probably Type UNS S 30400 (Type 304), or "18/8". Modifications include S 32100 (stabilized with titanium) and S 34700 (stabilized with niobium). Alloys having higher contents of chromium, nickel or molybdenum are available and provide increased corrosion resistance. Examples are S 31600, S 31700, S 30900 and S 31000. The 200 Series of austenitic special steels has, on the other hand, a reduced nickel content and contains manganese instead.

When special steel is annealed, hot rolled, etc., a layer of scale forms on the surface, which destroys the desired shiny metallic appearance of the steel surface. This surface layer must therefore be removed after this production step by a pickling process. The oxide-containing surface layer to be removed differs fundamentally from the oxide layer on low-alloy steels or on carbon steels. Apart from iron oxides, the surface layer contains oxides of the alloying elements, for example chromium, nickel, aluminum, titanium or niobium. Particularly in hot rolling, there is an accumulation of chromium oxide in the surface layer. The oxide layer is accordingly enriched with chromium rather than iron. Conversely, this means that the steel layer immediately underneath the oxide layer is depleted in chromium. A pickling process using suitable acidic pickling solutions preferentially dissolves this chromium-depleted layer underneath the oxide layer, with the result that the oxide layer is removed.

Pickling processes for special steel are well-known in the art. Earlier processes use nitric acid-containing pickling baths. These often additionally contain hydrofluoric acid, which on account of its complexing action with respect to iron ions promotes the pickling process. Although such pickling baths are economically efficient and technically satisfactory, they have the serious ecological disadvantage that they emit considerable amounts of nitrogen oxides and release large amounts of nitrates into the waste water.

Intensive efforts have therefore been made in the art to find alternative pickling and passivating processes that do not use nitric acid. Fe(III) ions are a possible substitute for the oxidizing action of nitric acid. The concentration of Fe(III) ions is maintained by hydrogen peroxide, which is added continuously or batch wise to the treatment baths. Such pickling or passivating baths contain about 15 to about 65 g/l of trivalent iron ions. During the pickling process, trivalent iron ions are converted to the divalent form. At the same time, further divalent iron ions are dissolved out from the pickled surface. The pickling bath is thereby depleted in trivalent iron ions during the operation, while divalent iron ions accumulate. The redox potential of the treatment solution is thereby displaced, with the result that the solution finally loses its pickling action. Divalent iron ions are oxidized back to the trivalent state by the continuous or batch wise addition of oxidizing agents, for example hydrogen peroxide, or other oxidizing agents, such as perborates, peracids or also organic peroxides. In this way, the redox potential necessary for the pickling or passivating action is maintained.

EP-B-505 606 describes a nitric acid-free process for the pickling and passivation of stainless steel, in which the material to be treated is immersed in a bath at a temperature of between 30 and 70° C. and which contains, at least at the beginning of the pickling process, at least 150 g/l of sulfuric acid, at least 15 g/l of Fe(III) ions, and at least 40 g/l HF. This bath furthermore contains up to about 1 g/l of additives, such as non-ionic surfactants and pickling inhibitors. Hydrogen peroxide is added continuously or batch wise to the bath in such amounts that the redox potential remains in the desired range. The other bath constituents are also replenished so that the concentration thereof remains within the optimum operating range. The pickling bath is agitated by blowing in air. Agitation of the pickling bath is necessary in order to achieve a uniform pickling result. A similar process, which differs from the above-described process basically only in the adjusted redox potential, is described in EP-A-582 121.

After the pickling, the surface is chemically activated, which means that, in air, the surface once again becomes coated with an optically interfering surface layer. This may be prevented by passivating the freshly pickled surfaces after or during the pickling. This may be performed in treatment solutions similar to the pickling solutions, a higher redox potential being used for the passivation than for the pickling process. This special passivation step forms an optically invisible passivation layer on the metal surface, and the steel surface thereby preserves its shiny metallic appearance. Whether a treatment solution behaves in a pickling or passivating manner with respect to special steel depends mainly on the established redox potential. Acidic solutions having pH values below about 2.5 have a pickling action if, on account of the presence of oxidizing agents, they have a redox potential in the range from about 200 to about 350 mV with respect to a silver/silver chloride electrode. If the redox potential is raised to values above about 300 to 350 mV, depending on the type of the stainless steel, the treatment solution has a passivating effect on the base alloy. In case of less noble materials (ferritic, martensitic grades) this inferior limit will shift to higher values.

During the pickling of stainless steel, in particular during the pickling of ferritic and martensitic stainless steel, but also during the pickling of austenitic stainless steel containing sulfur in the alloy, a gray black smut is formed during the pickling itself. This is due to the formation of by-products on the surface due to the pickling reaction. In particular ferritic and martensitic grades must be passivated after the pickling using high oxidizing chemical solutions in a separate step. This step provides both the bleaching of the material and the passivation of the surface.

The traditional bleaching/passivating solution used according to the state of the art is a solution formed by nitric acid at a concentration ranging from 6% to 20%, which may optionally contain small amounts of hydrofluoric acid (generally from 1 to 10 g/l). The possible requirement of the presence of HF is due to the fact that some ferritic and martensitic stainless steel grades need a light etching of the surface to allow an efficient bleaching of the surface itself. This means that two different solutions are necessary in practice, one containing HF to solve the problem described above, and another one free of HF, due to the fact that the presence of HF may increase too much the reaction rate on the base alloy, shifting the behaviour of the solution from passivation to etching. This would cause high metal dissolution of the base alloy and a further darkening of the surface.

Furthermore, due to the very low HF concentration used, the traditional bleaching/passivating system is extremely difficult to be controlled and replenished in a proper manner.

In recent years nitric acid free pickling processes were successfully applied in the stainless steel industry in order to solve the ecological problems caused by the presence of nitric acid. One of the remaining open problems for the complete removal of $HNO_3$ from the industrial plant was just the substitution of nitric acid in the passivation step. The problem solutions proposed were substantially based on acid solutions containing hydrogen peroxide as the oxidizing agent. However, the performance of these solution showed to be constantly inferior to the nitric acid containing solutions for two fundamental reasons:

a) The low stability of hydrogen peroxide during the use due to the destroying effect of the metal ions slowly dissolved from the outer surface during the process;
b) The poorer surface finishing quality of the ferritic/martensitic grades compared to the $HNO_3$ based solutions.

Possible solutions exist to solve problem a) (see, e.g., WO 01/49899 and GB 1,449,525), enabling hydrogen peroxide based solutions to tolerate iron ion concentrations as high as 10-15 g/l without destroying the excess of hydrogen peroxide necessary to get passivation. However, it is clear that a suitable industrial problem solution requires to have both problem a) and b) solved at the same time.

This difficulty is increased by the fact that in any case, when using nitric acid free passivation solutions for ferritic and martensitic grades, for many grades there always exists the need to add some HF to allow the bleaching of the surface, as for $HNO_3$ containing solutions. The addition of HF has the drawback to dissolve much more iron from the substrate, decreasing at the same time the shelf life of the hydrogen peroxide based passivation solution. In any case the surface quality obtained is normally lower than using $HNO_3$ based solutions.

Therefore, there is a need for a bleaching and/or passivating process, for ecological reasons preferably free from nitric acid, which can be used for various types of stainless steel without changing the composition of the process solution, and without the risk to re-etch the surface. In addition, there also is a need for a pickling process which does neither involve nitric acid nor free hydrofluoric acid, due to the possible environmental and health impact of these acids.

The invention is based on the discovery that the replacement of HF by complex fluoro acids of elements of groups 4, 13, or 14 (old notation: groups IVa, III, or IV, i.e. the groups beginning with the elements Ti, B, or C, respectively) of the periodic table of the chemical elements or anions thereof can solve the problems described above.

In a most general aspect, the subject matter of the present invention is the use of one or more complex fluoro acids of elements of groups 4, 13, or 14 of the periodic table of the chemical elements and/or anions thereof in concentrations from 30 to 500 millimoles per liter in process solutions for pickling steel or for bleaching and/or passivating pickled surfaces of stainless steel.

Whereas the bleaching and/or passivating step only makes sense for stainless steel, the pickling step in the present invention may be applied for stainless steel, but also for low-chromium steel, e.g. steel containing about 0.05 to 8% by weight, especially about 1% to about 2% by weight, of chromium. Thus, in this description of the invention, "pickling steel" includes pickling of stainless steel and pickling of low-chromium steel.

In solutions for the bleaching and/or passivating step, the complex fluoro acids and/or anions thereof are preferably present in a concentration of at least 30, preferably at least 65 mmoles per liter to 300, preferably to 220 mmoles per liter. However, the complex fluoro acids and/or anions thereof are used in concentrations of at least, with increasing preference, 50, 70, 100, or 170 millimoles per liter and at most, with increasing preference, 400, 350, or 280 millimoles per liter in process solutions for pickling stainless steel or steel with a chromium content of between 0.05 to 8% by weight.

These process solutions for pickling or for bleaching and/or passivating preferably contain one or more strong acids (always meaning: other than the complex fluoro acids throughout this disclosure) (defined as equally strong or stronger than phosphoric acid) in order to have a pH-value not higher than 2.5, preferably not higher than 1. This ensures high pickling and bleaching power of the process solution. Additionally, the strong acids keep the ionic strength of the solution approximately constant. Concentrations of the strong acids in the range of 10 to 200 g/l (as the total of the strong acids) in solutions for pickling and of 2 to 100 g/l in solutions for bleaching and/or passivating pickled surfaces are usually sufficient. The strong acids may, for example, be selected from nitric acid, phosphoric acid, hydrochloric acid, and sulfuric acid and mixtures thereof. Hydrochloric acid is less preferred, because it might lead to chloride pitting. Nitric acid works well as a strong acid to give the required low pH-value and/or as an oxidizing agent for the oxidation of Fe(II) ions to Fe(III) ions. But for the ecological reasons referred to above it is preferred that strong acids different from nitric acid are used, and also a different oxidizing agent than nitric acid. However, even if nitric acid is used, the present invention leads to the practical advantage especially for the bleaching/passivating step that only one bleaching solution can be used for all grades of stainless steel without the risk of over-etching the surface, instead of having to work with at least two different solutions (one free from HF, one containing HF), depending on the material to be bleached/passivated.

In addition, the process solution in the bleaching and/or passivating step contains an oxidizing agent which ensures that the surface of the pickled stainless steel is brought into the passivated state. Examples for oxidizing agents (which may be defined in the present case as agents which have an oxidizing power sufficient to oxidize Fe(II) ions to Fe(III) ions in acidic aqueous solutions) are: ferric ions themselves, permanganate ions, anions of oxo-acids of halogen atoms like chlorates or perchlorates (even if less preferred due to possible chloride pitting), or compounds containing peroxo groups like perborates, persulfuric acid, peroxodisulfuric acid, peroxides, or, most preferred for ecological reasons, $H_2O_2$. In all embodiments of the present invention, the oxidizing agent in the bleaching and/or passivating step is preferably present in a concentration, expressed as the equivalent concentration of $H_2O_2$, in a range from about 1, preferably from about 4, to about 30, preferably to about 20 g/l, calculated as undiluted $H_2O_2$. "Equivalent concentration of $H_2O_2$" means the concentration absorbing the same number of electrons in the redox reaction. These explanations of strong acids and oxidizing agents hold for all embodiments of the present invention, described above or below.

If $H_2O_2$ or compounds yielding $H_2O_2$ in the process solution in the bleaching and/or passivating step are used as the oxidizing agent, this process solution preferably also comprises a hydrogen peroxide stabilizer (referred to as component d) in claim 5) in order to prevent excessive decomposition of hydrogen peroxide caused by the catalytic action of transition metal ions in this process solution. If an efficient stabilizer is chosen, Fe(III) concentrations in the process solution in the bleaching and/or passivating step as high as 10 to 15 g/l are tolerated without causing excessive decomposition of hydrogen peroxide. Suitable stabilizers are known in the state of the art. For example, EP-A-582 121 discloses 8-hydroxyquinoline, sodium stearate, phosphoric acid, salicylic acid, pyridine carboxylic acid, and especially phenacetine as efficient stabilizers. Especially preferred stabilizers are saturated tertiary alcohols, as disclosed in IT 1246252, or glycole ethers, as taught in GB 1,449,525, especially in combination with phosphoric acid, as disclosed in WO 01/49899. Therefore, even if phosphoric acid is not chosen as a strong acid in component a), some phosphoric acid is preferably added as part of the stabilizer package.

In any aspect of the present invention, the complex fluoro acids of elements of groups 4, 13, or 14 of the periodic table of the chemical elements or anions thereof can be added as free acids or as salts, preferably alkaline metal salts, provided that they are soluble in the process solution at least in an amount to result in the indicated concentration of complex fluoro acids and/or anions thereof. In any case an equilibrium state between the acid and the anionic form of the complex fluoride ions will be established, depending on the pH value of the process solution and the dissociation constant of the complex fluoro acid. For reasons of availability, the complex fluoro acids of elements of groups 4, 13, or 14 of the periodic table of the chemical elements or anions thereof are preferably selected from complex fluoro acids and/or anions thereof of the elements B, Si, Ti, and Zr. Special examples are $BF_4^-$, $SiF_6^{2-}$, $TiF_6^{2-}$, and $ZrF_6^{2-}$, either in the form of the corresponding acids or of their salts. For economic and ecological reasons, $SiF_6^{2-}$ is especially preferred. Most preferably, the complex fluoro acids themselves are used to make up or to replenish the process solutions In a more special aspect, the subject matter of the present invention is a process solution for bleaching and/or passivating pickled surfaces of stainless steel comprising:

a) one or more strong acids other than the complex fluoro acids of group c), as explained above; preferably, but nor necessarily different from nitric acid, b) one or more oxidizing agents as outlined above, c) one or more complex fluoro acids of elements of groups 4, 13, or 14 of the periodic table of the chemical elements and/or anions thereof in concentrations from 50, preferably from 65 mmoles per liter, to 300, preferably to 220 mmoles per liter.

Preferably, for economical, ecological, and technical reasons, the oxidizing agent b) is selected from compounds containing a peroxo-group (most preferably: hydrogen peroxide), and the process solution for bleaching and/or passivating also contains a hydrogen peroxide stabilizer, examples of which have been given above.

As outlined above, also in this more special aspect of the present invention, in the process solution for bleaching and/or passivating a) the strong acid is present in a concentration from 2 to 100 g/l, and b) the oxidizing agent is present in a concentration, expressed as the equivalent concentration of $H_2O_2$, in the range from about 1, preferably from about 4, to about 30, preferably to about 20 g/l.

In a further aspect, the present invention comprises a process for bleaching (=brightening) and/or passivating of pickled surfaces of stainless steel, wherein the surfaces are brought into contact (by dip or spray processes) with a process solution according to one or more of claims 4 to 6, described in more detail above. In dip process the solution is preferably agitated by the injection of air or by mechanical agitation means. The process solution may have a temperature in the range from 15 to 40° C., preferably at most 30° C. The contact time depends on the type of stainless steel and on the kind of pickling treatment prior to the bleaching/passivating step. Usual contact times will be in the range from 10 seconds (for strip) to 10 minutes. The contact is terminated by rinsing the stainless steel surface with water, preferably in a power spray process, spraying water with elevated pressure onto the stainless steel surface.

The second main aspect of the invention is a process solution for pickling steel, including, as outlined earlier, stainless steel and low-chromium steel. Thus, the invention also comprises a process solution for pickling steel comprising:

a) one or more strong acids other than the complex fluoro acids of group c) in a total concentration of at least 10 g/l and at most 200 g/l.

c) one or more complex fluoro acids of elements of groups 4, 13, or 14 of the periodic table of the chemical elements and/or anions thereof in concentrations from 50 to 500 mmoles per liter, e) iron(III) cations in concentrations from at least 3 g/l, preferably at least 5 g/l, more preferably at least 10 g/l, to at most 100 g/l, more preferably at most 60 g/l, and, optionally d) a hydrogen peroxide stabilizer.

The hydrogen peroxide stabilizer d) is optional, as its presence is only advantageous when the oxidation if iron(II) ions formed in the pickling process are oxidized to iron(III) by using $H_2O_2$ in free or bound form. But this oxidation could be carried out by using other chemical oxidants like nitric acid, ozone, permanganate ions, perchloric acid, peroxo-acids of sulfur or phosphorous or the like. Or the oxidation of iron(II) may be performed electro-chemically, e.g. in a way analogous to the disclosure of WO97/43463 or of WO98/26111. Finally, this oxidation may be carried out using oxygen or an oxygen containing gas like air or air enriched with oxygen. In this case the oxidation occurs more efficiently if either a homogeneous or heterogeneous catalyst is present. The teaching of WO99/31296, of the unpublished PCT application PCT/EP02/09730, or of EP 795 628 may be applied analogously.

Iron(II) ions form in the pickling solution by the pickling reaction

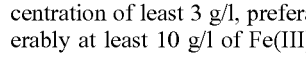

$$2Fe(III)+Fe(0)\rightarrow 3Fe(II)$$

where the base metal underlying the surface scale layer (in case of stainless steel: mainly the chromium depleted layer) is dissolved mainly by oxidation by Fe(III) ions. This reaction reduces the concentration of Fe(III) ions and increases the concentration of Fe(II) ions. Therefore, the redox potential will decrease according to the Nernst equation. To restore the redox potential and to have a sufficient "pool of redox power" available, Fe(II) ions have to be oxidized to Fe(III) ions by one of the ways outlined in the previous paragraph. A concentration of least 3 g/l, preferably at least 5 g/l, more preferably at least 10 g/l of Fe(III) ions is required to assure a sufficient "pool of redox power" for the pickling reaction. In a working pickling solution according to the invention, the concentration of Fe(III) ions will usually be in the range of 20 to 40 g/l. Maximum concentrations of 100 g/l or even of 60 g/l are usually sufficient for this purpose, and are rarely exceeded in practice.

A usual and convenient way to carry out the oxidation of Fe(II) is the addition of a hydrogen peroxide solution (e.g. as the technical product, which usually contains a conventional stabilizer added by the manufacturer, or one or more of the stabilizers described more above), either directly into the agitated pickling bath or, more preferably, into a conduit through which pickling solution is circulated. This addition of $H_2O_2$ does usually not lead to an excess of it in the bulk of the pickling solution, contrary to a bleaching/passivating solution. Instead, $H_2O_2$ is only added (continuously or at intervals) in an amount necessary to give the required concentration of Fe(III) ions and the required redox potential. To achieve this it is usually not necessary to oxidize all iron ions in the pickling solution to the trivalent state, even if this is possible. Instead, more preferably, a fraction of the total iron ions will still be present in the divalent state. In a working pickling solution the concentration of Fe(II) ions may be in the range of from about 5 to about 80 g/l. It is preferred, however, that the ratio of the concentrations of Fe(III):Fe(II) ions is at least 0.1, more preferably at least 0.3.

The concentration of total Fe ions (divalent and trivalent) is held below the upper limit (normally lower than 130 g/l and more preferably less than 100 g/l) mostly by drag-out of pickling solution adhering to the pickled surfaces, and by replenishment of the pickling solution with a replenisher solution not containing Fe ions. Alternatively, part of the spent pickling solution may be dumped and replaced by fresh pickling solution, or iron salts may be crystallized (e.g. by cooling the pickling solution) and removed.

The presence of Fe(II) ions in the working pickling solutions precludes the presence of excess $H_2O_2$, as this would oxidize the Fe(II) immediately. Despite of this it is still advantageous to use a hydrogen peroxide stabilizer in the pickling solution, e.g. one of those mentioned more above. The reason for this is that freshly added $H_2O_2$ will not only be used up by the oxidation of Fe(II), but also by spontaneous decomposition favored by the presence of transition metal ions in the pickling solution. The presence of a stabilizer in the bulk of the picking solution will slow down the decomposition reaction and will, therefore, increase the yield of the oxidation of Fe(II). Thus, the overall process needs less $H_2O_2$ and is, therefore, more economical when a hydrogen peroxide stabilizer is present.

Thus, a preferred pickling solution according to the present invention does not contain any other oxidant (defined as being able to oxidize Fe(II) to Fe(III) in the pickling solution) than the Fe(III) ions themselves and possibly oxygen which will be dissolved in the pickling solution by its contact with air, especially in the case of air-blowing or in spray application. However, if environmental concerns are less important or may be overcome by technical means, nitric acid may be used as an efficient and economic oxidant.

The pickling solution may comprise further additives or auxiliaries which are conventional in pickling solutions of the state of the art. For example, surfactants or emulsifiers may improve the wetting of the substrate, especially if tightly wound wire coils are pickled. Nonionic surfactants, e.g. polyethoxylated alkyl alcohols containing about 8 to about 22 C-atoms in the alkyl chain, may be used. Other useful additives include polishing agents and acid attack inhibitors. The total concentration of these additives is usually in the range of 0.1 to 2 g/l in the bath, and may be retained by feeding additive solutions if required.

The gist of this invention mainly lies in the replacement of free HF in pickling solutions, due to health and environmental impacts of free HF. Therefore, it is preferred that the pickling solution contains as little free HF as possible due to the equilibrium reactions in the pickling solution. "Free HF" means HF molecules or fluoride ions (able to form HF by reaction with hydronium cations in the acidic pickling solution) which are not used up for complex formation, e.g. with Fe(III) or Cr(III) ions in the pickling solution. Therefore, even if HF is added into the bath, this will not lead to the presence of "free HF" as long as it is used up to form these complexes. In extremely difficult pickling cases, however, it may be necessary to provide small concentrations of free HF for technical efficiency. But it is still preferred to limit the sum of the concentrations of free fluoride ions and HF molecules to less than 10 g/l, preferably to less than 5 g/l, and more preferably to less than 1 g/l.

However, for some stainless steel grades (e.g. austenitic grades, or grades of the 4xx series which have not been mechanically or chemically pretreated after annealing) the pickling speed increases when HF is added in an amount to complex a fraction or all of the Fe(III) and Cr(III) ions, but not necessarily to result in an excess of free HF. Therefore, it is advantageous in pickling these grades that at least a fraction of 1% of the Fe(III) ions and at most all of the Fe(III) ions are present as fluoride complexes.

It is known from EP 1 050 605 that catalytic concentrations of chloride ions in concentrations of between 0.1 to 10 g/l may increase the pickling speed. This is also true for pickling solutions according to the present invention. Therefore, the process solution of the present invention may additionally comprise chloride ions or hydrochloric acid in a total concentration of from 0.1 to 10 g/l, more preferably from 1 to 5 g/l.

The redox potential of the process solution for pickling (measured at the working temperature with a Pt/Ag/AgCl electrode and relative to this electrode, i.e. the potential of this secondary electrode is taken to be zero) is set and maintained at least 280 mV, preferably at least 300 mV. In practice, it will usually not be higher than 800 mV. As described above, the redox potential is managed by the addition of oxidants to the pickling solution in order to oxidize a fraction of the Fe(II) ions to Fe(III) ions.

Furthermore, the present invention comprises a process for pickling steel (stainless steel or low-chromium steel as described above), wherein the steel is brought into contact with a process solution as described here above. Preferably the pickling solution has a temperature between 20 and 80°

C.; more preferably between 30 and 70° C. The optimum temperature range may depend on the substrate and may be found empirically. The pickling may be carried out as a dip or as a spray process. Pickling times strongly depend on the type of steel, on its shape, and on the pretreatment between rolling or annealing and pickling. In practice, the time required for complete pickling will normally be in the range of from 1 to 90 Minutes. Pickling times may also depend on the presence of fluoro complexes of Fe(III) and/or on the presence of chloride ions. They will have to be optimized empirically.

Bath agitation or other means for moving the process solution relative to the pickled surfaces may shorten the time required for complete pickling. Therefore, it is preferred that the pickling solution is moved relatively to the surface of the steel. In spray application this happens automatically. It is also possible to move the material to be pickled within the bath solution. Other efficient means for agitation are stirring, pumping pickling solution in a loop, and especially blowing of air. In the latter case it is preferred that air is injected in the order of at least 3 $m^3/m^3$ bath per hour, e.g. in the order of 10 to 40 $m^3/m^3$ bath per hour.

During the pickling process the concentration of Fe(III) will diminish and the concentration of Fe(II) ions increase, as described above. This would lower the redox potential and diminish the pickling efficiency. Therefore, it is preferred that at least a fraction of the iron(II) formed during the pickling are oxidized to iron(III) ions. How this can be done has been explained above in connection with the pickling solution.

It should be evident from the description above that the process according to the present invention is part of the treatment chain: pretreatment (acid treatment, molten salt treatment, shot peening, mechanical cracking of the scale, and the like), pickling (in one ore more steps, e.g. using pickling solutions as quoted in the introductory part or according to the invention), bleaching/passivating according to the present invention or according to the state of the art, water rinse, and drying. At least one pickling step or one bleaching and/or passivating step has to be carried out according to the invention. Needless to say that it is most preferred to use at least one pickling step as well as a bleaching and/or passivating steps according to this invention.

The invention, either for pickling steel or for bleaching/passivating pickled stainless steel, can be applied to the production of stainless steel in any form, such as wire, rod, tube, plate, coil, and finished articles. It is possible to use a single process solution for bleaching and/or passivating all grades of ferritic and martensitic stainless steel, without the requirement to adjust the composition of the process solution to the grade of the stainless steel treated. The same solution can be used for removing smuts after pickling from the surface of austenitic grades containing sulfur (e.g. AISI 303). Compared to the state of the art of nitric acid free bleaching solutions, the process solution according to the present invention dissolves a smaller amount of alloy in order to get the necessary smut removal. This generates less waste, increases the speed, improves the surface finishing, and reduces the decomposition rate of hydrogen peroxide. Thus, the ecological and/or economic disadvantages of using $HNO_3$-based bleaching/passivating solutions can be avoided without any drawbacks or even with advantages in surface finishing or in process economy (e.g. waste generated, treatment time). And even if nitric acid is used as the strong acid, the present invention leads to the practical advantage that only one bleaching solution can be used for all grades of stainless steel without the risk of over-etching the surface, instead of having to work with at least two different solutions (one free from HF, one containing HF), depending on the material to be bleached/passivated.

If the pickling step is carried out according to the present invention, the composition of the pickling solution may be adjusted according to the material to be pickled and/or according to the pretreatment before pickling. E.g. it may not be necessary at all to add HF in order to complex iron(III) ions when stainless steel grades of the 4xx series are pickled, if they have previously been pretreated (molten salts, shoot blasting, KMnO4/NaOH solutions, scale breaking, etc). Especially when not pretreated 4xx grades are pickled, faster pickling is obtained when HF is added to the pickling solution in such an amount that at least a fraction of the iron(III) ions are complexed, but no free fluoride (i.e. fluoride ions not involved in complex formation) is present in the pickling solution. For the pickling of austenitic stainless steel, faster pickling also occurs when HF is added to the pickling solution in such an amount that at least a fraction of the iron(III) ions are complexed, but no free fluoride is present in the pickling solution. The presence of free fluoride or free HF, preferably at a concentration lower than 10 g/l, will be thus limited to specific critical situations that could be found in the practical industrial realty Depending on the substrate and on the type of pretreatment before pickling, pickling may be carried out in one or more steps, e.g. in two steps. The same or different bath compositions may be chosen for the different steps. The redox potential may also change from step to step and is usually higher in subsequent steps than in the first step. However, the total concentration of divalent and trivalent iron ions may be higher in the first step than in the subsequent steps.

It is well known in the art of pickling that the process solutions can be present in the form of a gel or a paste. For the process solution according to the present invention this is possible as well, and this is one possible embodiment of the present invention. Thickeners to be added to bring the process solution into this physical state are known in the art of pickling. Examples are inorganic thickeners based on aluminum, magnesium, or calcium oxides or mixtures thereof, organic thickeners like polyvinylpyrrolidone, cellulose ethers, and modified polyacrylic acids. Of course, mixtures of organic and inorganic thickeners may be used as well.

The active ingredients of the process solution, either for pickling steel or for bleaching/passivating pickled surfaces of stainless steel, are partly used up during the process. Therefore, they have to be replenished periodically or more or less continuously, either as a result of bath analysis or according to experience. For his purpose, the single components can be added separately, as required. However, it is usually preferred to add at least some of the components together in a replenisher solution, as this minimizes the number of different solutions which have to be added to the process solutions. Usually, the oxidizing agent is added separately from the other ingredients due to its instability. However, it may be added together with a hydrogen peroxide stabilizer. It is very practical, however, to add the strong acid, the complex fluoro compounds, and the hydrogen peroxide stabilizer together in one solution.

Therefore, yet another aspect of the present invention comprises a replenisher solution for a process solution according to one or more of claims 4 to 6 or 8 to 13, comprising a) one or more strong acids other than the complex fluoro acids of group c), c) one or more complex fluoro acids of elements of groups 4, 13, or 14 of the periodic table of the chemical elements and/or anions thereof, d) a hydrogen peroxide stabilizer in concentrations higher than those defined in claims 4, 6 or 8.

Of course, the explanations given above for preferred components a), c), and d) are valid for this aspect of the invention as well. Mass ratios of components a), c), and d) in the replenisher solutions may be chosen according to the experimentally determined consumption rates of these components in the process solution. The replenisher solution may comprise additional components if required, e.g. surfactants or other additives. The replenisher may also comprise HF, but preferably in an amount that HF is used up rapidly in the pickling bath by forming complexes with Fe(III) and Cr(III), without yielding an excess of free HF in the pickling bath.

EXAMPLES

Part I: Bleaching/Passivating Stainless Steel

Examples Series 1

AISI 420 F is one of the most critical grades according to the aim of the invention, due to the very high reactivity and due to moving in a quite complicated manner from the passivity to the activity regime (probably into the transpassivity regime using HNO3).

Wire samples of hot rolled AISI 420 F were pre-treated with reduction molten salts and then pickled for 10 minutes in sulfuric acid solution and for 10 minutes in a Cleanox® solution (commercialized pickling process of the applicant according to EP-B-582 121, based on $H_2SO_4$/HF/Fe(III), wherein the Fe(III) concentration and hence the redox potential is managed by the addition of hydrogen peroxide).

After rising the samples were completely dark due to the presence of black smut on the surface. The samples were weighted and then immediately brightened and passivated in different solutions for a time of 4 minutes at room temperature (25° C.) according to the state of the art (both nitric acid based or nitric acid free: comparative examples) and to the invention. After this step the samples were rinsed with a low pressure water spray for 1 minute, dried and weighted again. At the end the samples were evaluated visually to compare the surface brightness according to an arbitrary scale ranging from 1 to 5, where:

1=very bad (similar to the appearance before brightening)

2=bad (surface partially bleached; darkening of a white paper rubbed on the surface)

3=acceptable (quite bleached surface but still some residuals after white paper rubbing)

4=good (practically no black residuals passing paper on the surface, but not very homogeneous)

5=very good (completely bleached and homogeneous surface; no black residuals when rubbing the surface with the paper).

TABLE 1

| Bleaching results | | | | |
|---|---|---|---|---|
| Identification (comp. = comparative, inv. = invention) | Composition | Concentration (g/l) | Weight loss ($g/m^2$) | Surface Brightness |
| 1a (comp.) | $HNO_3$ | 100 | 28 | 4 |
| 2a (comp.) | $HNO_3$/HF | 100/2 | 125 | 3 |
| 1b (comp.) | $H_2SO_4/H_2O_2$ | 20/6 | 1.8 | 2 |
| 2b (comp.) | $H_2SO_4/H_2O_2$ | 80/6 | 1.9 | 3 |

TABLE 1-continued

| Bleaching results | | | | |
|---|---|---|---|---|
| Identification (comp. = comparative, inv. = invention) | Composition | Concentration (g/l) | Weight loss ($g/m^2$) | Surface Brightness |
| 3b (comp.) | $H_2SO_4/H_2O_2$ | 20/80 | 0.9 | 2 |
| 1c (comp.) | $H_2SO_4/H_2O_2$/HF | 20/6/2 | 111 | 2 |
| 2c (comp.) | $H_2SO_4/H_2O_2$/HF | 80/6/2 | 100 | 2 |
| 3c (comp.) | $H_2SO_4/H_2O_2$/HF | 20/24/2 | 70 | 4 |
| 4c (comp.) | $H_2SO_4/H_2O_2$/HF | 80/24/2 | 70 | 4 |
| 1d (comp.) | $H_2SO_4/H_2O_2/H_2SiF_6$ | 0/6/20 | 1.0 | 2 |
| 4d (inv.) | $H_2SO_4/H_2O_2/H_2SiF_6$ | 10/6/10 | 26.0 | 4 |
| 5d (inv.) | $H_2SO_4/H_2O_2/H_2SiF_6$ | 5/6/20 | 27.1 | 5 |
| 6d (inv.) | $H_2SO_4/H_2O_2/H_2SiF_6$ | 20/6/10 | 26.2 | 5 |
| 7d (inv.) | $H_2SO_4/H_2O_2/H_2SiF_6$ | 20/6/15 | 26.5 | 5 |
| 8d (inv.) | $H_2SO_4/H_2O_2/H_2SiF_6$ | 20/6/20 | 35.7 | 5 |
| 2e (inv.) | $H_3PO_4/H_2O_2/H_2SiF_6$ | 30/6/15 | 17.4 | 5 |
| 3e (inv.) | $H_3PO_4/H_2O_2/H_2SiF_6$ | 30/6/20 | 20.4 | 5 |

It is quite clear from the data in table 1 that the removal of the black smut covering the surface to get a clear and bright surface is strictly joined to a minimum weight loss during the operation (in this case 15-27 $g/m^2$). These data are comparable with the data obtained for $HNO_3$ solution.

The addition of HF to $HNO_3$ or the $H_2SO_4/H_2O_2$ system also at very low concentration generates immediately a re-etching of the base alloy with the tendency to generate again a gray-black surface, if one does not increase considerably the oxidizing agent concentration in the case of the $H_2SO_4/H_2O_2$ system. But this results in weight losses much higher than the reference ($HNO_3$), and thus in considerable costs due to consumption of hydrogen peroxide.

It is a clear advantage of adding fluoride complexes that one can work in a well manageable concentration range without causing the re-etching of the surface.

Examples Series 2

Another martensitic grade (AISI 410) was bleached after pickling to confirm the data obtained on the previous most difficult grade. The process sequence was the same as for example series 1.

TABLE 2

| Bleaching results | | | | |
|---|---|---|---|---|
| Identification (comp. = | | AISI 410 | | |
| comparative, inv. = invention) | Composition | Concentration (g/l) | Weight loss ($g/m^2$) | Surface Brightness |
| 1a (comp.) | $HNO_3$ | 100 | 1.0 | 4 |
| 2a (comp.) | $HNO_3$/HF | 100/2 | 10.5 | 5 |
| 1b (comp.) | $H_2SO_4/H_2O_2$ | 20/6 | 0.5 | 3 |
| 2b (comp.) | $H_2SO_4/H_2O_2$ | 20/20 | 0.3 | 3 |
| 3b (comp.) | $H_2SO_4/H_2O_2$ | 50/6 | 0.3 | 3 |
| 1c (comp.) | $H_2SO_4/H_2O_2$/HF | 20/6/2 | 11 | 5 |
| 2c (comp.) | $H_2SO_4/H_2O_2$/HF | 20/20/2 | 9.7 | 5 |
| 1d (inv.) | $H_2SO_4/H_2O_2/H_2SiF_6$ | 20/6/15 | 5.7 | 5 |
| 2d (inv.) | $H_2SO_4/H_2O_2/H_2SiF_6$ | 40/20/20 | 6.3 | 5 |
| 1e (inv.) | $H_3PO_4/H_2O_2/H_2SiF_6$ | 30/6/15 | 3.3 | 5 |
| 2e (inv.) | $H_3PO_4/H_2O_2/H_2SiF_6$ | 30/6/30 | 5.4 | 5 |

This grade of steel is an example where the addition of HF to the $HNO_3$ solution allows to improve the finishing of the stainless steel surface. As this steel is more corrosion resistant than AISI 420 F, the increase in weight loss is acceptable and does not cause any important re-etching of the base alloy. A similar behaviour is given by the $H_2SO_4/H_2O_2/HF$ solution with also similar weight losses. However, in this case the solution of the invention allows to get the best finishing result for all the combinations tested, but with a weight loss about 50% lower than the state of the art.

Examples Series 3

4xx Grades

Comparative behaviour among different complex fluoride acids was tested on two other different martensitic grades (420B, 420C1). Also the behaviour of the addition of fluorosilicic acid to $HNO_3$ was evaluated.

| | Solutions | | | | | | | |
|---|---|---|---|---|---|---|---|---|
| | 1 | 2 | 3 | 4 | 5 | 6 | 7 | 8 |
| $H_2SO_4$ g/l | | | 20 | | | 20 | 20 | 20 |
| $HNO_3$ g/l | 100 | 100 | | 25 | 100 | | | |
| HF g/l | | 1 | | | | | | |
| $H_2SiF_6$ g/l | | | 15 | 15 | 15 | | | |
| $H_2TiF_6$ g/l | | | | | | 17.1 | | |
| $H_2ZiF_6$ g/l | | | | | | | 21.6 | |
| $HBF_4$ g/l | | | | | | | | 13.7 |
| $H_2O_2$ g/l | | | 6 | | | 6 | 6 | 6 |

Results

| | 420B | | 420C1 | |
|---|---|---|---|---|
| Solution | Weight loss ($g/m^2$) | Bleaching index | Weight loss ($g/m^2$) | Bleaching index |
| 1 | 4.1 | 4 | 4.3 | 5 |
| 2 | 13.8 | 5 | 22.6 | 4 |
| 3 | 11.1 | 5 | 20.3 | 5 |
| 4 | 6.3 | 4 | 9.5 | 4 |
| 5 | 7.8 | 5 | 11.1 | 5 |
| 6 | 24.3 | 5 | 30.3 | 5 |
| 7 | 18.2 | 5 | 31.8 | 5 |
| 8 | 5.1 | 5 | 12.4 | 5 |

Examples Series 4

3xx Grades

One of the reasons to use a brightening solution for austenitic grades is the removal from the surface of possible smut or deposits forming during the pickling step. This can happen more often for the less noble austenitic grades such as the sulphur containing alloys. The surface of these grades at the end of the pickling could be covered by a gray/black smut due to the by-product reactions containing sulphate. In addition it can be possible that also copper, an element normally present in the pickling baths in which copper containing alloys are pickled, deposits on the steel surface forming a red brown film, that must be removed.

The following tests were made with AISI 303 grade wire samples.

Samples of AISI 303 were pickled in the following solutions:

| | Pickling solutions | |
|---|---|---|
| | CX 1 | CX 2 |
| $H_2SO_4$ | 100 g/l | 100 g/l |
| HF | 30 g/l | 30 g/l |
| $Fe^{3+}$ | 20 g/l | 20 g/l |
| $Fe^{2+}$ | 30 g/l | 30 g/l |
| $Cu^{+2}$ | — | 1.4 |
| Temperature | 35° C. | 35° C. |

After pickling in solutions CX 1 and CX 2, the samples where brightened for comparison in the brightening solutions A) B), and C) below for a time of 4 minutes.

| | Brightening solutions | | |
|---|---|---|---|
| | A) HNO3 | B) HNO3 + HF | C) Invention |
| $HNO_3$ g/l | 100 | 100 | // |
| HF g/l | // | 10 | // |
| $H_2SO_4$ g/l | // | // | 20 |
| $H_2O_2$ (100%), g/l | // | // | 20 |
| $H_2SiF_6$ g/l | // | // | 20 |
| $H_2O_2$ Stabilizer* | // | // | 7 |
| Temperature | 28° C. | 28° C. | 28° C. |

*Mixture 1:1 by weight of phosphoric acid and butylcellosolve[R]

After that the samples were rinsed with water by dip followed by a low pressure spray fresh water rinse. On the samples pickled in solution CX1 the weight loss during the brightening step were also measured:

| | | | Copper removal (Yes/No) | |
|---|---|---|---|---|
| | Weight loss ($g/m^2$) | Bleaching Index | After Dip rinsing | After spray rinsing |
| A) $HNO_3$ | 4.2 | 4 | No | Yes |
| B) $HNO_3$ + HF | 24.6 | 5 | No | Yes |
| C) Invention | 1.5 | 5 | Yes | Yes |

The solution C) according to the invention showed very good brightening properties together with a very low weight loss. In addition the copper removal ability was better than in the traditional solution, being effective also without the final spray rinse.

Part II: Pickling Steel

A. Chemical Equilibria and Redox Potential Values (Pt/Ag/AgCl)

One of the aspects different compared to the traditional technology according to EP 505 606 is that the concentration of Fe3+ available as free (i.e. uncomplexed) in the pickling solution is much higher. From the literature data and from the experimental ones in the system:

$$Fe^{3+}—Fe^{2+}—H_2SO_4—H_2SiF_6$$

there is no remarkable complex formation between $Fe^{3+}$ and $H_2SiF_6$. The redox potential measurements gives a clear indication of that:

| $Fe^{3+}$, g/l | $Fe^{2+}$ g/l | E (mV) |
|---|---|---|
| | Data 1. Solution $H_2SO_4$ = 120 g/l $H_2SiF_6$ = 0 | |
| 33.97 | 14.7 | 472 |
| | Data 2. Solution $H_2SO_4$ = 120 g/l $H_2SiF_6$ = 50 g/l | |
| 30.86 | 12.79 | 464 |

In a solution containing initially $H_2SO_4$=120 g/l and $H_2SiF_6$=34 g/l were added 26.7 g of $Fe^{2+}$ (added as $FeSO_4$*7 $H_2O$) and the redox potential measured. Step by step part of the bivalent iron was oxidized with Hydrogen peroxide and the redox potential read at each oxidation step:

| $Fe^{3+}$, g/l | $Fe^{2+}$, g/l | E (mV) |
|---|---|---|
| 0 | 26.7 | 270 |
| 0.3 | 26.4 | 337 |
| 5.5 | 20.9 | 402 |
| 11.9 | 14.6 | 425 |
| 19.4 | 6.9 | 467 |
| 25.6 | 1.0 | 537 |

The data obtained for $Fe^{3+}$=0 was possible only using fresh analytical grade reagent. On the contrary using an industrial raw material a very small amount of $Fe^{3+}$ (as in the second experimental data) is sufficient to get a redox potential value higher than 300 mV.

There is no special influence of the single acids on the redox potential value in absence of trivalent iron:

| $Fe^{3+}$, g/l | $Fe^{2+}$ g/l | E (mV) |
|---|---|---|
| | Solution $H_2SO_4$ = 0 g/l $H_2SiF_6$ = 34 g/l | |
| 0 | 26 | 265 |
| | Solution $H_2SO_4$ = 120 g/l $H_2SiF_6$ = 0 | |
| 0 | 26 | 271 |
| | Solution $H_2SO_4$ = 0 $H_2SiF_6$ = 0 | |
| 0 | 26 | 260 |

The strong effect of $Fe^{3+}$ on the redox potential compared to traditional pickling solution according to EP 505 606 should be due to the fact that there is no strong complex between $Fe^{3+}$ and the anions in the solution.

The influence of the addition of HF to the solution confirmed its stronger influence on the redox potential value due to the $Fe^{3+}$ complexation, as can be seen in the following experiment, in which HF was added at different step to a solution originally without HF.

| $Fe^{3+}$ g/l | $Fe^{2+}$ g/l | $H_2SO_4$ g/l | $H_2SiF_6$ g/l | HF added g/l | E, mV |
|---|---|---|---|---|---|
| 9.9 | 37.8 | 120 | 34 | 0 | 0.390 |
| | | | | 1 | 0.390 |
| | | | | 5 | 0.373 |
| | | | | 10 | 0.347 |
| | | | | 20 | 0.303 |
| | | | | 37.2 | 0.249 |

By adding HF the redox potential starts to decrease. For HF=10 g/l all the $Fe^{3+}$ present was theoretically complexed and the redox potential decreased of about 50 mV compared to the starting solution. Adding other 10 g/l more of HF (20 as total and 10 as theoretical HF free) the redox potential value decreased by other 50 mV.

B. Pickling Data

Example B1

Stainless Steel Grades 400

Stainless steel wire samples AISI 416 and AISI 420 were pickled in different solutions, after pre-treatment in reduction molten salts (Ferropur). Two different pickling temperature (30° C., 40° C.) were also investigated.

| | F1 | F2 | F3 (comparative) |
|---|---|---|---|
| $H_2SO_4$, g/l | 120 | 120 | 120 |
| $H_2SiF_6$, g/l | 50 | 17 | 50 |
| $Fe^{3+}$ g/l | 30.8 | 30.8 | <1 |
| $Fe^{2+}$ g/l | 12.8 | 12.8 | 13.11 |
| Total $F^-$ (added as HF), g/l | 0 | 0 | 0 |

At the end of the pickling cycle the samples were bleached and passivated in a solution according to the "bleaching aspect" of this invention:

$H_2SO_4$ $H_2SiF_6$ $H_2O_2$

Stabilizer

These cycle was compared with a Cleanox® 352 (a process according to EP 505 606) pickling cycle using the following pickling and bleaching solutions:

| Parameter | Cleanox 352 pickling solution (comparative) | Cleanox 352 bleaching solution (comparative) |
|---|---|---|
| $Fe^{3+}$ g/l | 25 | |
| $Fe^{2+}$ g/l | 35 | |
| $H_2SO_{4\,free}$ g/l | 100 | 30 |
| $HF_{free}$ g/l | 25 | |
| Total $F^-$ g/l | 50 | |
| $H_2O_2$ g/l | | 6.0 |

The results are summarized in the tables below (CX=Cleanox; m.p.t.=minimum pickling time; n.d.=not determined)

| T = 30° C. | AISI 416 F1 | AISI 416 F2 | AISI 416 F3 (comparative) | AISI 416 CX 352 | AISI 420 F F1 | AISI 420 F F2 | AISI 420 F F3 (comparative) | AISI 420 F CX 352 |
|---|---|---|---|---|---|---|---|---|
| Minimum Pickling time, seconds | 600 | 600 | >>1000 | 480 | 300 | 300 | >>1000 | 480 |
| Weight loss at m.p.t. g/m$^2$ | 85.7 | 106.9 | n.d. | 142 | 30.7 | 37.3 | n.d. | 124 |

| T = 40° C. | AISI 416 F1 | AISI 416 F2 | AISI 420 F F1 | AISI 420 F F2 |
|---|---|---|---|---|
| Minimum Pickling time, seconds | 300 | 300 | 180 | 240 |
| Weight loss at m.p.t. g/m$^2$ | 84.9 | 85.9 | 47.5 | 63 |

The following general observation can be made:

There was a negligible pickling reaction in absence of $Fe^{3+}$ ions (F3 comparative solution) The minimum pickling time to get a completely de-scaled surface can be decreased compared to the reference for any concentration of $H_2SiF_6$ by changing the temperature The weight loss at the minimum pickling time is strongly reduced with the new process compared to a process according to the state of the art (Cleanox®). An increase of the temperature using Cleanox® on these grades is not possible because it will cause over-pickling of the surface.

Example B2

Not Pre-Treated 4xx Grades

Samples of AISI 430 as rolled and annealed but without any mechanical or chemical-physical pre-treatment were pickled in solution F1. A second solution was prepared adding to this solution 30 g/l of total fluoride as HF (Solution F4). This fluoride was complexed by $Fe^{3+}$ ions present in the solution to form fluorocomplexes $FeF_x^{(3-x)}$ in such a way to have no free HF present in the solution. For comparison a Cleanox® solution as in example 1 was tested. The pickling for which the surface was visually free of oxides was noted as minimum pickling time.

The results are shown in the table below (for abbreviations see Tables above).

| T = 30° C. | F1 | F4 | CX 35 (comparison) |
|---|---|---|---|
| $H_2SO_4$, g/l | 120 | 120 | 100 |
| $H_2SiF_6$, g/l | 50 | 17 | — |
| $Fe^{3+}$, g/l | 30.8 | 30.8 | 25 |
| $Fe^{2+}$, g/l | 12.8 | 12.8 | 35 |
| Total $F^-$ (added as HF), g/l | 0 | 30 | 50 |
| $HF_{free}$, g/l | 0 | 0 | 25 |
| Minimum Pickling time, (minutes) | → ∞ | 15 | 19 |
| Weight loss at m.p.t. g/m2 | n.d. | 34.9 | 226.5 |

In this case due to the very compact oxide structure the solution tested in example 1 was completely unable to pickle the surface. The addition of fluoride in $FeF_x$ complexed form allowed to get a surface completely free of scale, decreasing the minimum pickling time compared to the Cleanox® reference solution and with a minimum weight loss of the sample.

Example B3

Austenitic Stainless Steel

AISI 304/4 wire samples were pickled by immersion in different solutions in which were kept constant: the sulphuric acid concentration, $Fe^{3+}$ and $Fe^{2+}$ concentration and the pickling temperature (45° C.). The ratio between $H_2SiF_6$ and the total fluoride was varied. Pickling result was evaluated at steps of 5 minutes and were evaluated when the surface was completely free of oxide by visual observation.

| | S1 | S2 | S3 | S4 | S5 | S6 | S7 | S8 |
|---|---|---|---|---|---|---|---|---|
| $H_2SO_4$, g/l | 120 | 120 | 120 | 120 | 120 | 120 | 120 | 120 |
| $H_2SiF_6$, g/l | 50 | 50 | 50 | 50 | 34 | 34 | 34 | 34 |
| $Fe^{3+}$, g/l | 30 | 30 | 30 | 30 | 30 | 30 | 30 | 30 |
| $Fe^{2+}$, g/l | 14.5 | 14.5 | 14.5 | 14.5 | 14.5 | 14.5 | 14.5 | 14.5 |
| Total $F^-$ (added as HF) | 0 | 10 | 20 | 30 | 0 | 10 | 20 | 30 |
| $HF_{free}$, g/l | 0 | 0 | 0 | 0 | 0 | 0 | 0 | 0 |
| Minimum Pickling time (minutes) | 10 | 10 | 10 | 10 | 10 | 5 | 5 | 5 |
| Weight loss at m.p.t. g/m$^2$ | 88.2 | 91.9 | 96.6 | 106.4 | 87.0 | 85.3 | 92.6 | 94.7 |

| | S9 | S10 | S11 | S12 | Cleanox solution (comparison) |
|---|---|---|---|---|---|
| $H_2SO_4$, g/l | 120 | 120 | 120 | 120 | 120 |
| $H_2SiF_6$, g/l | 17 | 17 | 17 | 17 | — |
| $Fe^{3+}$, g/l | 30 | 30 | 30 | 30 | 30 |
| $Fe^{2+}$, g/l | 14.5 | 14.5 | 14.5 | 14.5 | 14.5 |
| Total $F^-$ (added as HF) | 0 | 10 | 20 | 30 | 56 |
| $HF_{free}$, g/l | 0 | 0 | 0 | 0 | 25 |
| Minimum Pickling time | 10 | 5 | 5 | 5 | 5 |
| Weight loss at m.p.t. | 85 | 85.8 | 90.8 | 88.5 | 93.6 |

Example B4

Austenitic Stainless Steel AISI 304 L

The previous test was repeated by pickling a steel more difficult than 304/4.

| | S1 | S2 | S3 | S4 | S5 | S6 | S7 | S8 |
|---|---|---|---|---|---|---|---|---|
| $H_2SO_4$, g/l | 120 | 120 | 120 | 120 | 120 | 120 | 120 | 120 |
| $H_2SiF_6$, g/l | 50 | 50 | 50 | 50 | 34 | 34 | 34 | 34 |

-continued

| | | | | | | | | |
|---|---|---|---|---|---|---|---|---|
| $Fe^{3+}$, g/l | 30 | 30 | 30 | 30 | 30 | 30 | 30 | 30 |
| $Fe^{2+}$, g/l | 14.5 | 14.5 | 14.5 | 14.5 | 14.5 | 14.5 | 14.5 | 14.5 |
| Total $F^-$ (added as HF), g/l | 0 | 10 | 20 | 30 | 0 | 10 | 20 | 30 |
| $HF_{free}$, g/l | 0 | 0 | 0 | 0 | 0 | 0 | 0 | 0 |
| Minimum Pickling time, min | >70 | 60 | 45 | 35 | >70 | 60 | 35 | 35 |
| Weight Loss at m.p.t. g/m$^2$ | n.d. | 135 | 154.3 | 195.2 | n.d. | 152 | 153 | 177 |

| | S9 | S10 | S11 | S12 | Cleanox solution (comparison) |
|---|---|---|---|---|---|
| $H_2SO_4$, g/l | 120 | 120 | 120 | 120 | 120 |
| $H_2SiF_6$, g/l | 17 | 17 | 17 | 17 | |
| $Fe^{3+}$, g/l | 30 | 30 | 30 | 30 | 30 |
| $Fe^{2+}$, g/l | 14.5 | 14.5 | 14.5 | 14.5 | 14.5 |
| Total $F^-$ (added as HF), g/l | 0 | 10 | 20 | 30 | 56 |
| $HF_{free}$, g/l | 0 | 0 | 0 | 0 | 25 |
| Minimum Pickling time (minutes) | >70 | 60 | 35 | 35 | 35 |
| Weight loss at m.p.t. g/m$^2$ | n.d. | 153 | 158 | 195 | 196 |

The data confirmed that quite well that in the case of austenitic steel, even if pickling only using $H_2SiF_6$ without the addition of HF is possible, the minimum pickling time is quite longer than the time of the conventional Cleanox® process. The time decreased to comparable values when fluoride in form of ferric fluoride complexes was added at a concentration of about 20 g/l (as $F^-$), with the advantage to get the pickling with a lower total weight loss (g/m$^2$).

Apparently the best results where obtained when $H_2SiF_6$ was in the range 17-34 g/l.

C. Influence of Sulphuric Acid Concentration

Using AISI 304 L austenitic stainless steel the following solutions were compared at a temperature of 45° C.:

| T = 45° C. | S13 | S14 | S15 |
|---|---|---|---|
| $H_2SO_4$, g/l | 60 | 120 | 160 |
| $H_2SiF_6$, g/l | 34 | 34 | 34 |
| $Fe^{3+}$, g/l | 30 | 30 | 30 |
| $Fe^{2+}$, g/l | 14.5 | 14.5 | 14.5 |
| Total $F^-$ (added as HF), g/l | 20 | 20 | 20 |
| $HF_{free}$, g/l | 0 | 0 | 0 |
| Minimum Pickling time (minutes) | 35 | 35 | 35 |
| Weight loss at m.p.t. | 157.7 | 153 | 149 |

These data clearly show that there is no relevant influence of sulphuric acid concentration on the pickling efficiency in the range 60-160 g/l, at least when $H_2SiF_6$ is kept constant.

D. Catalytic Effect of Chlorides

Catalytic amount of chloride were tested in solutions as S13 and S15 adding 2 g/l of $Cl^-$ ions as ferrous chloride ($FeCl_2$). Thus the solutions in the table below were compared and the following results obtained:

| T = 45° C. | S13 | S15 | S16 | S17 |
|---|---|---|---|---|
| $H_2SO_4$, g/l | 60 | 160 | 60 | 160 |
| $H_2SiF_6$, g/l | 34 | 34 | 34 | 34 |
| $Cl^-$, g/l | — | — | 2 | 2 |
| $Fe^{3+}$, g/l | 30 | 30 | 30 | 30 |
| $Fe^{2+}$, g/l | 14.5 | 14.5 | 14.5 | 14.5 |
| Total $F^-$ (added as HF), g/l | 20 | 20 | 20 | 20 |
| $HF_{free}$, g/l | 0 | 0 | 0 | 0 |
| Minimum Pickling time (minutes) | 35 | 35 | 25 | 25 |
| Weight loss at m.p.t. | 157.7 | 149 | 157.8 | 167.4 |

In both cases the addition of 2 g/l of chlorides accelerated the process, on this quite common stainless steel grade, by reducing the minimum pickling time of about 30%.

D. Effect of the Temperature

Solution S15 was tested at 3 different temperatures always using 304 L stainless steel wire samples.

| | T = 45° C. | T = 55° C. | T = 63° C. |
|---|---|---|---|
| Minimum pickling time (minutes) | 35 | 20 | 15 |
| Weight loss at m.p.t. | 149 | 152 | 157 |

By increasing the temperature it was possible to strongly reduce the minimum pickling time without practically increasing the weight loss and thus in the chemical consumption as normally happens with conventional pickling solutions according to EP 505 606.

E. Pickling Tests Using Fluoboric Acid Instead of Fluosilicic Acid

A comparative test was made at a temperature of 45° C. on AISI 304 L with and without HF added to the solutions between fluoroboric and fluorosilicic acids using the same molar concentration.

| T = 45° C. | S5 | S7 | S18 | S19 |
|---|---|---|---|---|
| $H_2SO_4$, g/l | 120 | 120 | 120 | 120 |
| $H_2SiF_6$, g/l | 34 | 34 | — | — |
| $HBF_4$, g/l | — | — | 20.7 | 20.7 |
| $Fe^{3+}$, g/l | 30 | 30 | 30 | 30 |
| $Fe^{2+}$, g/l | 14.5 | 14.5 | 14.5 | 14.5 |
| Total $F^-$ (added as HF) | 0 | 20 | 0 | 20 |
| $HF_{free}$, g/l | 0 | 0 | 0 | 0 |
| Minimum pickling time (minutes) | >70 | 35 | >70 | 45 |
| Weight loss at m.p.t.. g/m$^2$ | n.d. | 153 | n.d. | 147.7 |

The test shows that pickling mechanism is the same and the results are quite similar. Fluorosilicic acid works a little better concerning both minimum pickling time and surface finishing (brighter surface). This males it probable that other complex fluoro acids with similar complex stabilities and acid strenghths, like complex fluoro acids of Ti and Zr, as well as anions thereof, also behave similarly Effect of the $Fe^{3+}/Fe^{2+}$ Ratio on the Pickling Result.

Three different grades of austenitic stainless steel wire samples were pickled in the following solutions according to the invention:

| | LK | HK |
|---|---|---|
| $Fe^{3+}$, g/l | 20.3 | 36.2 |
| $Fe^{2+}$, g/l | 34 | 11.5 |
| E, mV | 363 | 398 |
| $H_2SO_4$, g/l | 100 | 100 |
| $H_2SiF_6$, g/l | 34 | 34 |
| Total $F^-$ g/l (added as HF) | 19 | 30 |
| $HF_{free}$, g/l | 0 | 0 |

The samples were pickled at 45° C. step by step till to get the surface completely free from oxide scale by visual observation. The table below shows the test results in terms of weight losses at the end of the pickling and the minimum pickling time (m.p.t.) observed:

| Sol. | | 302BK molten salts pre-treated | E308L molten salts pre-treated | E316L8 as annealed |
|---|---|---|---|---|
| LK | m.p.t., minutes | 20.0 | 40.0 | 60 |
| | Weight loss, g/m$^2$ | 111.7 | 102.7 | 171.3 |
| HK | m.p.t., minutes | 20.0 | 35 | 55 |
| | Weight loss, g/m$^2$ | 131.8 | 112.5 | 168.4 |

The data showed that there is very little or no effect at all of the $Fe^{3+}/Fe^{2+}$ ratio on the pickling rate.

Pickling of Low Chromium Containing Steel

Samples of steel, low chromium containing steel (about 1.5%), commercially named 100Cr6, normally pickled in HCl baths, were pickled according the invention. After pickling the material in the industrial cycle is bleached/neutralized in an alkaline oxidizing solution and then phosphatized with a high coating weight zinc phosphating solution. Pickling solutions normally used to pickle stainless steel are normally very aggressive for pickling low chromium steel and cannot be used in practice.

The following solutions were compared:

| | Invention | Comparison |
|---|---|---|
| HCl, g/l | — | 200 |
| $Fe^{2+}$, g/l | 28.2 | 50 |
| $Fe^{3+}$, g/l | 15.7 | — |
| $H_2SO_4$, g/l | 100 | — |
| $H_2SiF_6$, g/l | 34 | — |
| T, ° C. | 30-50-60 | 65 |
| Agitation by air blowing | Yes | No |

Results:

| | | T = 30° C. | T = 50° C. | T = 60° C. | T = 65° C. |
|---|---|---|---|---|---|
| Invention | m.p.t., minutes | 25 | 15 | 10 | — |
| | Weight loss, g/m$^2$ | 85.5 | 90.4 | 105 | — |
| Comparison | m.p.t., minutes | — | — | — | 20 |
| | Weight loss, g/m$^2$ | — | — | — | 82.1 |

Agitation was noted to affect positively the pickling result in case of the invention. The data showed that the pickling time can be strongly reduced, whereas the weight loss is only slightly increased. Even if the surface finishing after pickling was less bright than in the case of the comparative solution, the final result after phosphating was comparable very well.

The invention claimed is:

1. A process for pickling steel, comprising:

chemically pickling steel by contacting said steel with a process solution for a time sufficient to obtain a completely de-scaled surface; and managing redox potential of the process solution such that the redox potential, measured at process solution working temperature with a Pt/Ag/AgCl electrode, is at least 280 mV and up to 800 mV, such that said steel is chemically pickled;

wherein the process solution comprises:

a) one or more strong acids other than the complex fluoro acids of group b), and different from nitric acid and hydrochloric acid, in a total concentration of at least 10 g/l and at most 200 g/l, b) one or more complex fluoro acids of Si and/or anions thereof in concentrations from 50 to 500 mmoles per liter, c) optionally, a hydrogen peroxide stabilizer, d) iron(III) cations in concentrations from at least 3 g/l to at most 100 g/l, and e) a total of from 0.1 to 10 g/l of chloride ions and/or hydrochloric acid, the process solution containing in addition an amount of fluoride ions and/or hydrofluoric acid such that at least 1% and up to 100% of the iron(III) ions are present in the form of fluoride complexes, and such that the process solution contains less than 1 g/l of free fluoride ions and less than 1 g/l of free hydrofluoric acid.

2. The process according to claim 1 wherein said process solution contains no other oxidizing agent than the iron(III) ions and dissolved oxygen, said iron (III) cations concentration being at least 5 g/l to at most 100 g/l, and the concentration of b) being at least 170 mmoles per liter to at most 500 mmoles per liter.

3. The process according to claim 1, wherein the strong acids other than the complex fluoro acids of group b) are selected from sulfuric acid, phosphoric acid, and mixtures thereof.

4. The process according to claim 1, wherein the process solution is in the form of a gel or a paste.

5. The process according to claim 1 wherein the process solution is moved relative to the surface of the steel.

6. The process according to claim 1 wherein at least a fraction of iron(II) ions formed during the pickling are oxidized to iron(III) ions.

7. The process according to claim 1 wherein the process solution contains an amount of fluoride ions and hydrofluoric acid such that at least 1% and up to 100% of the iron(III) ions are present in the form of fluoride complexes.

8. The process according to claim 1 wherein the process solution contains an amount of hydrofluoric acid such that at least 1% and up to 100% of the iron(III) ions are present in the form of fluoride complexes.

9. The process according to claim 1 wherein the process solution comprises:

b) one or more complex fluoro acids of Si and/or anions thereof in concentrations from 50 to 220 mmoles per liter.

10. The process according to claim 9 wherein the process solution contains an amount of fluoride ions and hydrofluoric acid such that at least 1% and up to 100% of the iron(III) ions are present in the form of fluoride complexes.

11. The process solution according to claim 9 wherein the process solution contains an amount of hydrofluoric acid such that at least 1% and up to 100% of the iron(III) ions are present in the form of fluoride complexes.

12. A process for chemical pickling of steel, comprising:

chemically pickling steel by contacting said steel with a pickling solution for a time sufficient to obtain a completely de-scaled surface; and managing redox potential of the process solution such that the redox potential, measured at process solution working temperature with a Pt/Ag/AgCl electrode, is at least 280 mV and up to 800 mV, such that said steel is chemically pickled;

wherein the pickling solution comprises a) one or more strong acids other than the complex fluoro acids of group b), and different from nitric acid and hydrochloric acid, in a total concentration of at least 10 g/l and at most 200 g/l, b) one or more complex fluoro acids of Si and/or anions thereof in concentrations from 50 to 500 mmoles per liter, c) optionally, a hydrogen peroxide stabilizer, and d) iron(III) cations in concentrations from at least 3 g/l to at most 100 g/l, the pickling process solution containing in addition an amount of fluoride ions and/or hydrofluoric acid such that at least 1% and up to 100% of the iron(III) ions are present in the form of fluoride complexes, but such that it contains less than 5 g/l of the total of free fluoride ions and less than 5 g/l of the total of free hydrofluoric acid.

13. The process according to claim 12 wherein the process solution contains no other oxidizing agent than the iron(III) ions and dissolved oxygen.

14. The process according to claim 12 wherein the process solution additionally contains a total of from 0.1 to 10 g/l of chloride ions and/or hydrochloric acid.

15. The process according to claim 12 wherein the process solution is moved relative to the surface of the steel.

16. The process according to claim 12 wherein the concentration of d) iron(III) cations is from at least 5 g/l to at most 60 g/l.

17. The process according to claim 12 wherein the process solution contains an amount of fluoride ions and hydrofluoric acid such that at least 1% and up to 100% of the iron(III) ions are present in the form of fluoride complexes.

18. The process according to claim 12 wherein the process solution contains an amount of hydrofluoric acid such that at least 1% and up to 100% of the iron(III) ions are present in the form of fluoride complexes.

* * * * *